US009439831B2

(12) United States Patent
Ta

(10) Patent No.: US 9,439,831 B2
(45) Date of Patent: Sep. 13, 2016

(54) LIQUID CONTAINER WITH REPLACEABLE LINER

(71) Applicant: Lan Van Ta, Valencia, CA (US)

(72) Inventor: Lan Van Ta, Valencia, CA (US)

( * ) Notice: Subject to any disclaimer, the term of this patent is extended or adjusted under 35 U.S.C. 154(b) by 110 days.

(21) Appl. No.: 14/605,001

(22) Filed: Jan. 26, 2015

(65) Prior Publication Data

US 2016/0213563 A1 Jul. 28, 2016

(51) Int. Cl.
*A47K 3/022* (2006.01)
*A61H 35/00* (2006.01)
*A45D 29/00* (2006.01)

(52) U.S. Cl.
CPC ..... *A61H 35/006* (2013.01); *A45D 29/00* (2013.01); *A47K 3/022* (2013.01)

(58) Field of Classification Search
CPC ..... A61H 35/006
USPC ..... 4/619, 621, 622, 655
See application file for complete search history.

(56) References Cited

U.S. PATENT DOCUMENTS 6,772,800 B1 * 8/2004 Garcia ..... A47K 3/022 141/2
7,950,079 B2 5/2011 Ta
2004/0199994 A1 * 10/2004 Sherif ..... A47K 3/022 4/622
2008/0276365 A1 * 11/2008 Ton ..... A47K 3/002 4/622
2009/0094739 A1 * 4/2009 Vinokur ..... A61H 33/025 4/622
2014/0259374 A1 9/2014 Ta

* cited by examiner

*Primary Examiner* — Huyen Le
(74) *Attorney, Agent, or Firm* — Miller Law Group, PLLC

(57) ABSTRACT

A pedicure bowl has a bottom discharge drain opening communicating with a discharge duct and is arranged to receive a liner to ensure hygienic operation in the form of a thin flexible material applied over the inner surface to contain the liquid within the liner and to cover the drain opening. The drain opening is closed by the liner so that liquid within the container applies downward pressure on the liner at the drain opening and a sealing member is mounted in the duct downstream of the drain opening to prevent air flow so as to form a back pressure underneath the liner to prevent the downward pressure from rupturing the liner. The sealing member is operable to release the back pressure to cause the liner at the discharge opening to rupture.

13 Claims, 4 Drawing Sheets

LIQUID CONTAINER WITH REPLACEABLE LINER

This invention relates to liquid container into which can be applied a liner and particularly to an arrangement for discharge of the liquid from the container with the liner in place. The container is provided with a liner of a simple film of suitable impermeable material, typically plastics, which is applied into the container to contact the liquid.

Such a container can be provided as a basin or bowl typically used for cosmetic procedures such as manicures and pedicures where the liner is used for hygienic, so that the next time the container is used, the user can be sure that the bowl is protected against contamination by use of a new liner.

However the arrangement of the present invention, where the container is covered by a simple replaceable liner, can be provided for other uses of the container, for example for protection of the container from the contents.

Professional salons today allow customers to receive numerous services, such as facials, manicures, and pedicures. To facilitate these services, spa chairs are often used to allow clients to sit and relax while they receive facials, manicures, and pedicures. Such spa chairs often include a pedicure basin at the foot of the chair to facilitate pedicure services and foot massages. The pedicure basin generally includes warm water for cleaning, comfort and to complement the massaging affect.

Reference is made to U.S. Pat. No. 7,950,979 issued May 31 2011 to the present Applicant and to US Published Application 2014/0259374 published Sep. 18, 2014 filed by the present Applicant, the disclosures of which are incorporated herein by reference, which show examples of a basin of this type. This conventional pedicure basin has a drain at the bottom for draining the water present in the pedicure basin. However, although the water is drained out of the pedicure basin, residual material is left behind, including possible bacteria, germs and other contaminates from the client's feet. If not thoroughly washed and sanitized, the next client to use the pedicure basin is exposed to the bacteria and germs from the previous client. This poses a serious sanitation issue.

The potential of spreading germs among clients through various tools and equipment, including the pedicure basin, is well known within the manicure and pedicure industries. As such, it is common practice in the industry to apply a liner over the pedicure basin, which may be easily replaced for the next client. The liner is typically either a plastic bag type (like a trash bag) or a harder plastic that has been molded to fit like a shell in the pedicure basin. Utilizing a liner around the pedicure basin is cost effective and efficient, compared to the alternative of having to thoroughly clean and sanitize the pedicure basin after each use. With a liner applied over the pedicure basin, the drain is blocked. As such, a water-filled pedicure basin with a liner will commonly require that the plastic be punctured to drain the water into the drain hole of the pedicure basin. Alternatively, and less commonly, the water may be drained by pouring the water out over a sink. Thereafter, the used liner is replaced, and the pedicure basin is filled with new water for the next client.

The blockage of the drain by the liner poses another challenge. The drain is convenient for not only draining the water completely from pedicure basin, but also for partially draining the water from the pedicure basin. This may be convenient in the scenario where one client may want to adjust the temperature of the water in the pedicure basin. One easy means of doing this is by draining some of the water through the drain and adding additional warm water or cool water to adjust the water temperature within the pedicure basin. If some of the water is not drained, there is the possibility of overflowing the pedicure basin through the addition of the desired warm or cool water. Of course, with a liner, the drain is blocked, and thus the pedicure basin cannot be easily drained.

BRIEF SUMMARY OF THE INVENTION

It is one object of the present invention therefore to provide a container a disposable liner and can be easily emptied allowing the liner to be removed and replaced.

According to the invention there is provided an apparatus for containing and subsequently discharging liquid comprising:

a container with an inner surface and an open top;

a bottom discharge drain opening in the container communicating with a discharge duct;

a liner in the form of a thin flexible material applied over the inner surface to contain the liquid within the liner and to cover the drain opening;

the drain opening being closed by the liner so that liquid within the container applies downward pressure on the liner at the drain opening;

a sealing member mounted in the duct downstream of the drain opening;

the sealing member being operable to move to a sealing position in which air flow through the duct from the discharge opening is prevented so as to form a back pressure underneath the liner to counter the downward pressure on the liner from the liquid and so as to prevent the downward pressure from rupturing the liner;

the sealing member being operable to move to an open position in which air flows through the duct to discharge so as to release the back pressure;

the liner being arranged relative to the discharge opening such that release of the back pressure causes the liner at the discharge opening to rupture in response to the downward pressure from the liquid thereby allowing the liquid to pass through the discharge opening to the duct.

Preferably the sealing member is operable by an actuator located downstream of the discharge opening.

Preferably the sealing member is located in the duct at a position spaced from the discharge opening so that the sealing member does not contact the liner.

Preferably the sealing member is located in the duct at a position spaced from the discharge opening so that the discharge opening is closed only by the liner.

Preferably the liner is continuous and closed over the discharge opening so as to allow the liquid to pass to the discharge opening only by rupturing an opening in the liner.

In one arrangement the sealing member comprises a plunger slidable within the duct from a forward position closing the duct in front of a discharge duct portion to a rearward position in which the air followed by the liquid flows from the discharge opening to the discharge duct portion.

In another arrangement the sealing member comprises a flap valve extending across the duct and movable between the sealed position closing the duct to a release position in which the air followed by the liquid flows from the discharge opening through the discharge duct.

The flap valve can be operable by moving a magnet or can be movable directly by a manually operable lever.

Preferably the container comprises a bowl which is supported with the open top arranged to allow parts of a body of a patient to be inserted into the bowl. However other uses of this arrangement can be provided where hygienic effect is required to prevent transfer of any contamination from one patient to another.

Thus the container can comprise a manicure or pedicure bowl.

The design for a new and improved pedicure basin is disclosed. This design may be applied to spa chairs with an integrated pedicure basin or removal pedicure basin. The design is particularly useful for pedicure basins where a liner blocks the drain hole.

According to another definition of the invention there is provided an apparatus for containing and subsequently discharging liquid comprising:

a container with an inner surface and an open top;

a bottom discharge drain opening in the container communicating with a discharge duct;

the container being arranged to receive a liner in the form of a thin flexible material applied over the inner surface to contain the liquid within the liner and to cover the drain opening;

the drain opening being arranged to be closed by the liner so that liquid within the container applies downward pressure on the liner at the drain opening;

a sealing member mounted in the duct downstream of the drain opening;

the sealing member being operable to move to a sealing position in which air flow through the duct from the discharge opening is prevented so as to form a back pressure underneath the liner to counter the downward pressure on the liner from the liquid and so as to prevent the downward pressure from rupturing the liner;

the sealing member being operable to move to an open position in which air flows through the duct to discharge so as to release the back pressure;

the liner being arranged relative to the discharge opening such that release of the back pressure causes the liner at the discharge opening to rupture in response to the downward pressure from the liquid thereby allowing the liquid to pass through the discharge opening to the duct.

According to a further definition of the invention there is provided a method for containing and subsequently discharging liquid comprising:

providing a container with an inner surface and an open top and a bottom discharge drain opening in the container communicating with a discharge duct;

applying a replaceable liner in the form of a thin flexible material applied over the inner surface to contain the liquid within the liner and to cover the drain opening;

the drain opening being closed by the liner so that liquid within the container applies downward pressure on the liner at the drain opening;

sealing the duct against air flow through the duct from the discharge opening so as to form a back pressure underneath the liner to counter the downward pressure on the liner from the liquid and so as to prevent the downward pressure from rupturing the liner;

releasing air to flow through the duct to discharge so as to release the back pressure such that release of the back pressure causes the liner at the discharge opening to rupture in response to the downward pressure from the liquid thereby allowing the liquid to pass through the discharge opening to the duct.

The container can be used as a pedicure basin particularly of the design shown in the above is comprised of a main basin and a secondary basin that accommodates overflow of fluids (typically water) from the main basin. A portion of the rim, where the main basin is interconnected with a secondary basin, has a lower edge, thus allowing the fluid from the main basin to overflow to the secondary basin. In another embodiment of this pedicure basin design, the secondary basin completely surrounds the main basin and allows for overflow of fluids from any part of the rim of the main basin to the secondary basin.

BRIEF DESCRIPTION OF THE DRAWINGS

A more complete appreciation of the invention and many of the advantages thereof will be readily obtained as the same becomes better understood by reference to the detailed description when considered in connection with the accompanying drawings, wherein.

DETAILED DESCRIPTION

Figure 1:
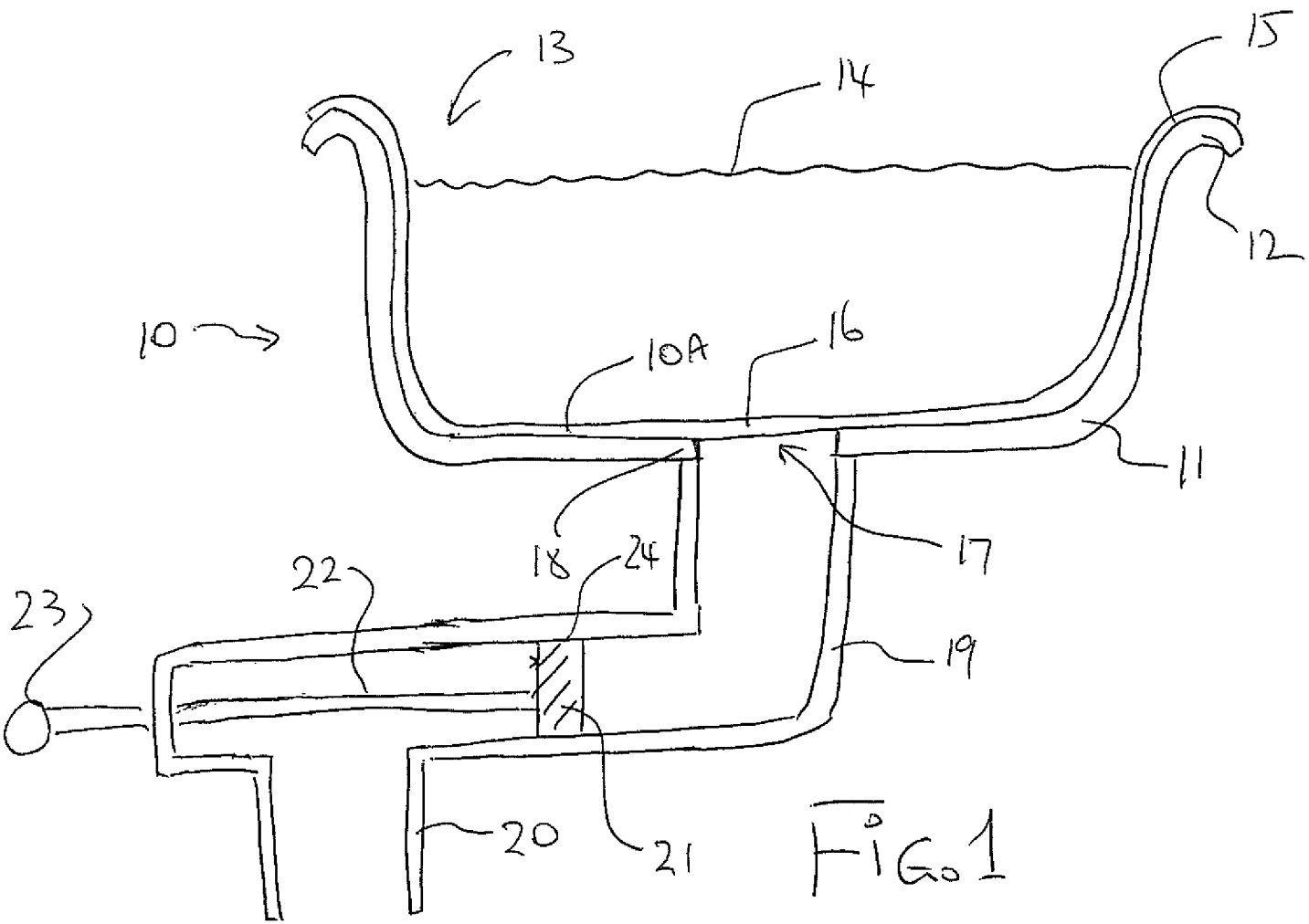
FIG. 1 shows a cross-sectional view of a first embodiment of pedicure bowl according to the present invention showing the bowl in the sealed position containing the liquid.

The arrangement shown in FIGS. 1 and 2 comprises a container 10 for containing and subsequently discharging a liquid 14. As set forth above, the container is typically a manicure or pedicure bowl but the arrangements for supporting the bowl and presenting the bowl and liquid to a patient in a chair is not shown as this is well known to a person skilled in the art.

The apparatus 10 comprises the container 10 with an inner surface 10A and an open top 13 defined by an upper lip 12 surrounding the open top 13.;

A bottom discharge drain opening 17 is provided in the container communicating with a discharge duct 19. The connections for the discharge duct to the container are shown only schematically since such plumbing constructions are of course again well known to a person skilled in this art.;

A liner 15 in the form of a thin flexible material is applied over the inner surface to contain the liquid within the liner and to provide a portion 16 to cover the drain opening 17. The liner is not shaped and arranged to match the bowl but can be a simple generic sheet or strip of thin liner material with no shaping but stretchable to match the bowl. Plastics material such as that sold under the trade mark Cling Film can be suitable and remain in place over the inner surface of the bowl by the pressure from the liquid and by the slight adhesive effect of the film. There is no specific adhesive required since the liner should be readily removable and disposable.

The drain opening 17 closed by the liner passing over the opening 17 at the portion 16 so that liquid 14 within the container applies downward pressure on the liner at the drain opening. It will be appreciated that the pressure of water above the portion 16 will, when sufficiently deep cause the portion 16 to fracture and tear under the pressure.

In order to proven the fractures, a sealing member 21 is mounted in the duct 19 downstream of the drain opening 17 where the sealing member is operable by a manually operable plunger 22 to move to a sealing position shown in FIG. 1 in which air flow through the duct from the discharge opening is prevented by a sealing surface 24 on the inside surface of eh duct so as to form a back pressure underneath the liner portion 16 to counter the downward pressure on the liner from the liquid and so as to prevent the downward pressure from rupturing the liner at the portion 16.

Figure 2:
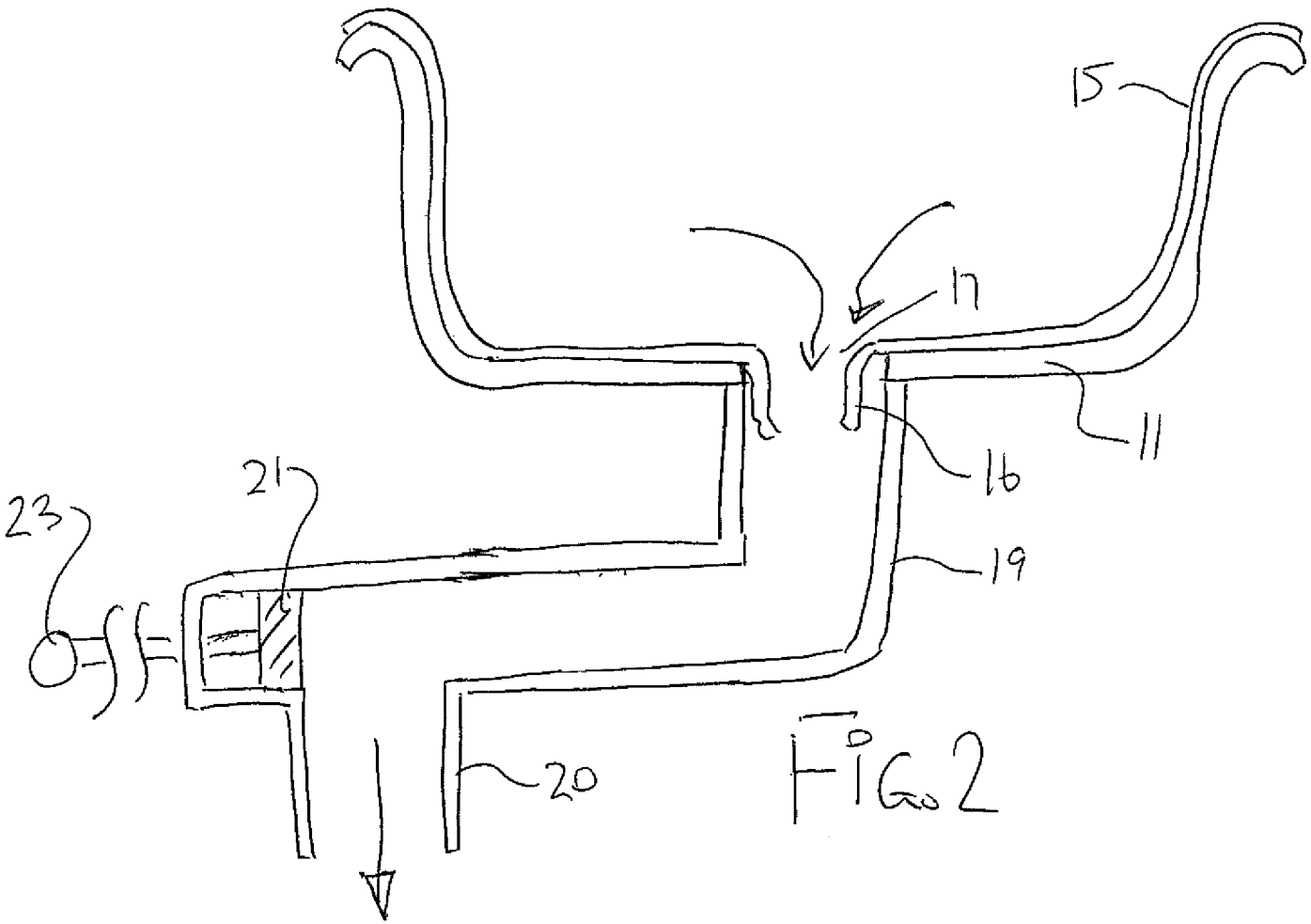
FIG. 2 shows a cross-sectional view of the bowl of FIG. 1 in the discharge position for releasing the liquid for application of a fresh liner.

The sealing member is operable by the plunger 22 using a manual handle 23 to move to an open position shown in FIG. 2 where the sealing member 21 is withdrawn behind a discharge portion 20 of the duct. In the open position air flows through the duct 19 to the discharge portion 20 to discharge so as to release the back pressure. This causes the liner at the discharge opening to rupture in response to the downward pressure from the liquid thereby allowing the liquid to pass through the discharge opening 17 to the duct 19.

The sealing member 21 is operable by the actuator 23 which is located downstream of or underneath the discharge opening 17.

The sealing member is located in the duct 19 at a position spaced from the discharge opening 17 so that the sealing member does not in any way contact the liner at the portion 16 or to provide any support for the liner or to close the discharge opening 17.

The sealing member 21 is thus located in the duct 19 at a position spaced from the discharge opening 17 so that the discharge opening is closed only by the liner.

The liner is continuous and closed over the discharge opening so as to allow the liquid to pass to the discharge opening only by rupturing an opening in the liner. That is there is no spout portion of the liner or any other opening in the liner at the portion 16. This allows the liner to be formed solely from the sheet which is not in any way tailored to the bowl shape.

As shown in FIGS. 1 and 2 the sealing member 21 comprises a plunger 22 slidable within the duct from a forward position shown in FIG. 1 closing the duct in front of a discharge duct portion 20 to a rearward position shown in FIG. 2 in which the air in the duct 19 between the portion 16 and the seal 24 is released followed by the liquid which flows from the discharge opening 17 to the discharge duct portion 20 caused by the fracture under liquid pressure of the portion 16.

Figure 3:
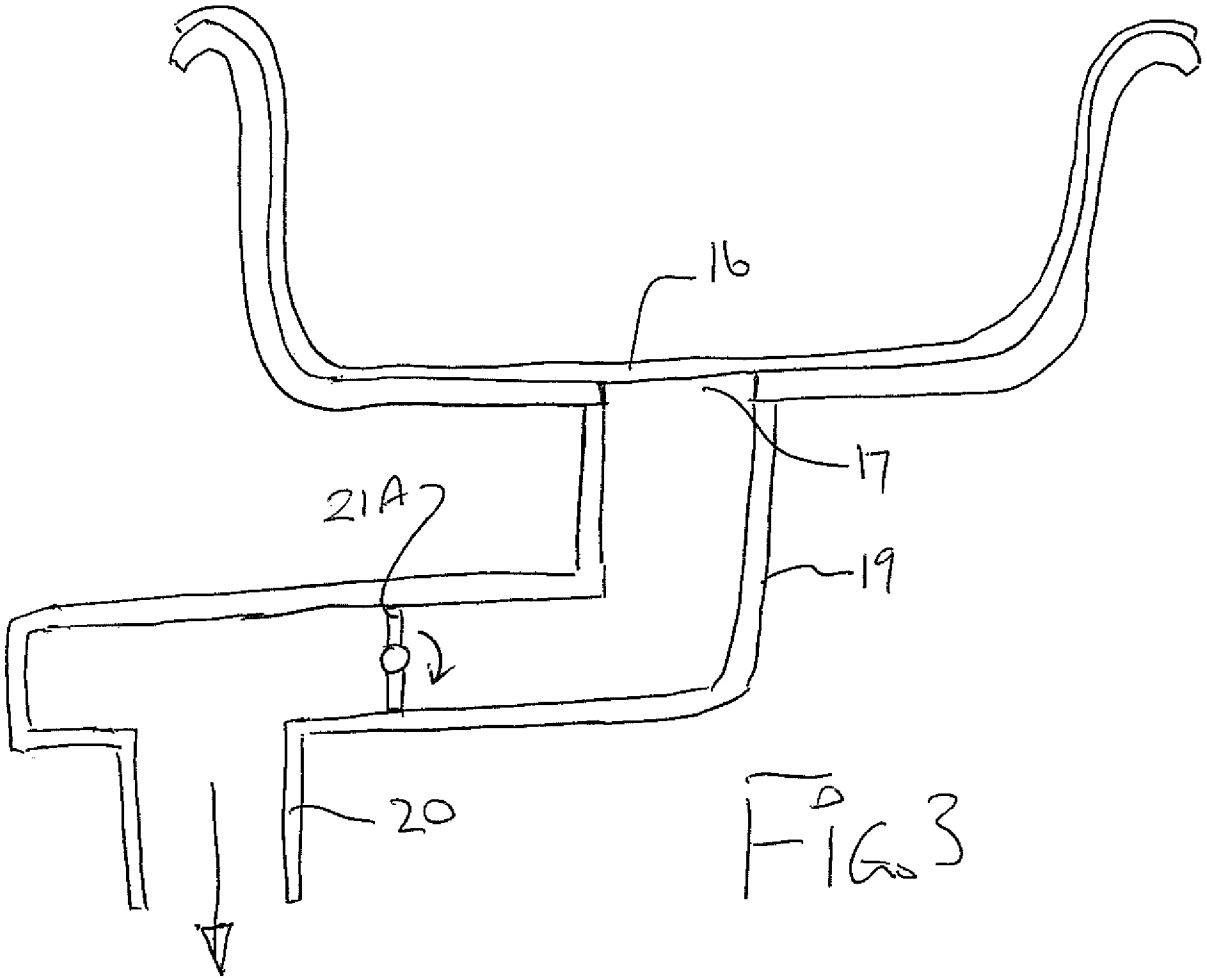
FIG. 3 shows a cross-sectional view of a second embodiment of pedicure bowl according to the present invention showing the bowl in the sealed position containing the liquid.
Figure 4:
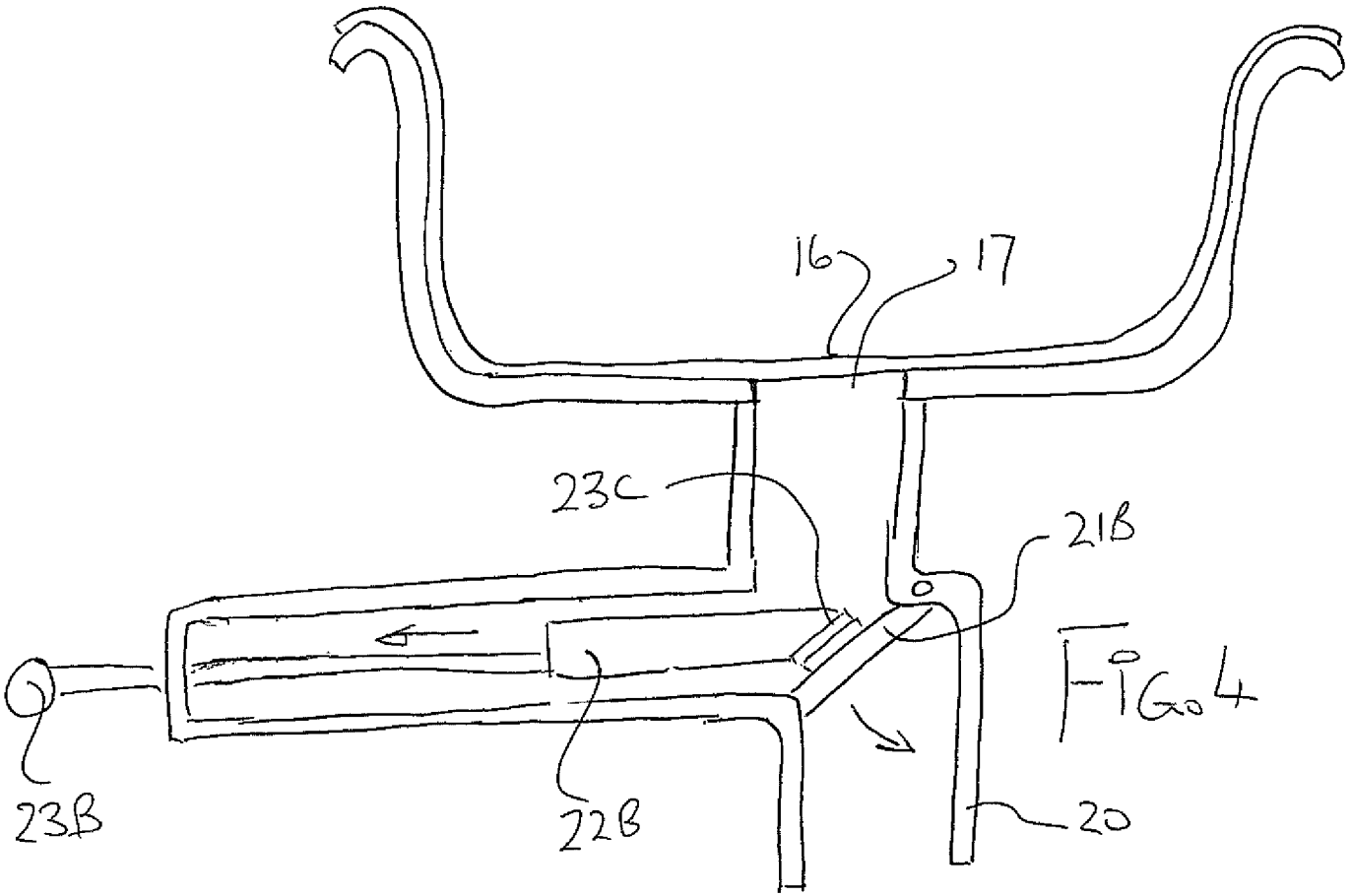
FIG. 4 shows a cross-sectional view of a third embodiment of pedicure bowl according to the present invention showing the bowl in the sealed position containing the liquid.

As shown in FIGS. 3 and 4 the sealing member comprises a flap valve 21A extending across the duct 19 and movable between the sealed position shown closing the duct to a release position in which the flap valve is not engaged with or sealing the duct 19 in which the air released by moving the flap valve followed by the liquid flows from the discharge opening through the discharge duct.

In FIG. 4, the flap valve 21B is operable by moving a magnet 23C which is attached to an end of a plunger 22B by pulling the magnet away from the flap 21B allowing the flap to pivot away from the wall of the duct.

It will be appreciated that many arrangements for operating movement of the sealing member can be provided and those shown are merely examples.

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

The invention claimed is:

1. An apparatus for containing and subsequently discharging liquid comprising:

a container with an inner surface and an open top;

a bottom discharge drain opening in the container communicating with a discharge duct;

a liner in the form of a thin flexible material applied over the inner surface to contain the liquid within the liner and to cover the drain opening;

the drain opening being closed by the liner so that liquid within the container applies downward pressure on the liner at the drain opening;

a sealing member mounted in the duct downstream of the drain opening;

the sealing member being operable to move to a sealing position in which air flow through the duct from the discharge opening is prevented so as to form a back pressure underneath the liner to counter the downward pressure on the liner from the liquid and so as to prevent the downward pressure from rupturing the liner;

the sealing member being operable to move to an open position in which air flows through the duct to discharge so as to release the back pressure;

the liner being arranged relative to the discharge opening such that release of the back pressure causes the liner at the discharge opening to rupture in response to the downward pressure from the liquid thereby allowing the liquid to pass through the discharge opening to the duct.

2. The apparatus according to claim 1 wherein the sealing member is operable by an actuator located downstream of the discharge opening.

3. The apparatus according to claim 1 wherein the sealing member is located in the duct at a position spaced from the discharge opening so that the sealing member does not contact the liner.

4. The apparatus according to claim 1 wherein the sealing member is located in the duct at a position spaced from the discharge opening so that the discharge opening is closed only by the liner.

5. The apparatus according to claim 1 wherein the liner is continuous and closed over the discharge opening so as to allow the liquid to pass to the discharge opening only by rupturing an opening in the liner.

6. The apparatus according to claim 1 wherein the sealing member comprises a plunger slidable within the duct from a forward position closing the duct in front of a discharge duct portion to a rearward position in which the air followed by the liquid flows from the discharge opening to the discharge duct portion.

7. The apparatus according to claim 1 wherein the sealing member comprises a flap valve extending across the duct and movable between the sealed position closing the duct to a release position in which the air followed by the liquid flows from the discharge opening through the discharge duct.

8. The apparatus according to claim 7 wherein the flap valve is operable by moving a magnet.

9. The apparatus according to claim 1 wherein the container comprises a bowl which is supported with the open top arranged to allow parts of a body of a patient to be inserted into the bowl.

10. The apparatus according to claim 1 wherein the container comprises a manicure or pedicure bowl.

11. The apparatus according to claim 1 wherein the container comprises a pedicure bowl.

12. An apparatus for containing and subsequently discharging liquid comprising:

a container with an inner surface and an open top;

a bottom discharge drain opening in the container communicating with a discharge duct;

the container being arranged to receive a liner in the form of a thin flexible material applied over the inner surface to contain the liquid within the liner and to cover the drain opening;

the drain opening being arranged to be closed by the liner so that liquid within the container applies downward pressure on the liner at the drain opening;

a sealing member mounted in the duct downstream of the drain opening;

the sealing member being operable to move to a sealing position in which air flow through the duct from the discharge opening is prevented so as to form a back pressure underneath the liner to counter the downward pressure on the liner from the liquid and so as to prevent the downward pressure from rupturing the liner;

the sealing member being operable to move to an open position in which air flows through the duct to discharge so as to release the back pressure;

the liner being arranged relative to the discharge opening such that release of the back pressure causes the liner at the discharge opening to rupture in response to the downward pressure from the liquid thereby allowing the liquid to pass through the discharge opening to the duct.

13. A method for containing and subsequently discharging liquid comprising:

providing a container with an inner surface and an open top and a bottom discharge drain opening in the container communicating with a discharge duct;

applying a replaceable liner in the form of a thin flexible material applied over the inner surface to contain the liquid within the liner and to cover the drain opening;

the drain opening being closed by the liner so that liquid within the container applies downward pressure on the liner at the drain opening;

sealing the duct against air flow through the duct from the discharge opening so as to form a back pressure underneath the liner to counter the downward pressure on the liner from the liquid and so as to prevent the downward pressure from rupturing the liner;

releasing air to flow through the duct to discharge so as to release the back pressure such that release of the back pressure causes the liner at the discharge opening to rupture in response to the downward pressure from the liquid thereby allowing the liquid to pass through the discharge opening to the duct.

* * * * *